US010970960B2

(12) United States Patent
Graboyes et al.

(10) Patent No.: US 10,970,960 B2
(45) Date of Patent: Apr. 6, 2021

(54) INTERACTIVE VIDEO GAMING SYSTEM INVOLVING A MATCHING FEATURE AND MULTIPLE PAY TABLES AND METHOD OF UTILIZING THE SAME

(71) Applicant: GameCo, LLC, Las Vegas, NV (US)

(72) Inventors: Blaine Goldman Graboyes, Las Vegas, NV (US); Eli Weissman, Brooklyn, NY (US); Jared Torres, Henderson, NV (US)

(73) Assignee: GAMECO, LLC, Las Vegas, NV (US)

( * ) Notice: Subject to any disclaimer, the term of this patent is extended or adjusted under 35 U.S.C. 154(b) by 0 days.

(21) Appl. No.: 16/367,289

(22) Filed: Mar. 28, 2019

(65) Prior Publication Data

US 2020/0312082 A1 Oct. 1, 2020

(51) Int. Cl.
*G07F 17/32* (2006.01)
*G07F 17/34* (2006.01)

(52) U.S. Cl.
CPC ..... *G07F 17/3213* (2013.01); *G07F 17/3246* (2013.01); *G07F 17/34* (2013.01)

(58) Field of Classification Search
CPC ..... G07F 17/3202; G07F 17/3204; G07F 17/3209; G07F 17/3211; G07F 17/3246; G07F 17/3248; G07F 17/326; G07F 17/3262; G07F 17/3265; G07F 17/3279; G07F 17/329
See application file for complete search history.

(56) References Cited

U.S. PATENT DOCUMENTS

| | | | | |
|---|---|---|---|---|
| 6,663,487 | B1 | 12/2003 | Ladner | |
| 8,061,714 | B2 | 11/2011 | Roemer et al. | |
| 8,616,961 | B2 | 12/2013 | Boyd et al. | |
| 9,564,020 | B1 | 2/2017 | D'Aquilante | |
| 9,947,168 | B2 | 4/2018 | Bennett et al. | |
| 2004/0033829 | A1* | 2/2004 | Pacey | G07F 17/3265 463/20 |
| 2006/0003831 | A1 | 1/2006 | Falciglia | |
| 2007/0243921 | A1 | 10/2007 | Fanjoy et al. | |
| 2009/0108526 | A1 | 4/2009 | Moody | |
| 2016/0343211 | A1 | 11/2016 | Graboyes Goldman et al. | |
| 2016/0364948 | A1 | 12/2016 | Parviainen et al. | |
| 2017/0301178 | A1 | 10/2017 | Thomas et al. | |
| 2018/0190080 | A1* | 7/2018 | Washington | G07F 17/3209 |

FOREIGN PATENT DOCUMENTS

| | | | |
|---|---|---|---|
| JP | 2008-043511 | A | 2/2008 |
| KR | 10-2013-0132364 | A | 12/2013 |

OTHER PUBLICATIONS

International Search Report and Written Opinion for PCT/US2020/025826 dated Jul. 28, 2020; 9 pages.

* cited by examiner

*Primary Examiner* — Omkar A Deodhar
(74) *Attorney, Agent, or Firm* — FisherBroyles, LLP; Rob L. Phillips

(57) ABSTRACT

A system and method for operating a casino-style video game with a matching feature whereby players seek to group like game icons with one another. The system may use multiple pay tables with a relevant pay table being selected based on the number of grouped game icons forming a winning pattern such that the greater the number of matched or grouped game icons, the greater the return to player (RTP) associated with the corresponding pay table.

11 Claims, 11 Drawing Sheets

420

400-2

400-3

INTERACTIVE VIDEO GAMING SYSTEM INVOLVING A MATCHING FEATURE AND MULTIPLE PAY TABLES AND METHOD OF UTILIZING THE SAME

FIELD OF THE INVENTION

The embodiments of the present invention relate to a gaming system having a matching feature with multiple pay tables premised on a number of matches.

BACKGROUND

New younger gamblers have different needs than their older counterparts. Older gamblers are content pressing a slot machine SPIN button and waiting for the random outcome. Younger players desire more interaction and intellectual involvement with their video-based games of chance. Developers of skill-based and pseudo skill-based games of chance are seeking to attract the younger players.

Accordingly, it would be advantageous to develop a gaming system having an interactive matching feature with multiple pay tables premised on a number of matches.

SUMMARY

The embodiments of the present invention are directed to a system and method for operating a casino-style video game with a matching feature whereby players seek to group like game icons with one another. In one embodiment, the system involves multiple pay tables with a relevant pay table being selected based on the number of grouped game icons. In one embodiment, the greater the number of matched or grouped game icons, the greater the return to player (RTP) associated with the selected pay table.

One system embodiment of the present invention comprises a gaming machine comprising: at least a processor running executable instructions related to running a casino game; display; a user interface; ticket reader, bill validator, memory in communication with said processor, said memory storing at least multiple pay tables; and wherein said processor running said executable instructions: (i) causes to be displayed a grid comprising a plurality of unique game icons; (ii) receives a player input consistent with moving one or more of said plurality of unique game icons to group like game icons; (iii) responsive to said player input being deemed proper, causes to be moved said one or more of said plurality of game icons and a bet amount to be deducted; (iv) if said move causes three or more like game icons to be grouped in a pre-established pattern, identifies a corresponding pay table, based on a number of grouped like game icons in said pre-established pattern, from said multiple pay tables stored in said memory; and (iv) awards a prize from said identified pay table.

One method embodiment of the present invention comprises utilizing a processor running executable instructions to run a casino game on a gaming machine including a display, user interface, ticket reader, bill validator, and memory in communication with said at least one processor; via said processor; causing to be displayed a grid comprising a plurality of unique game icons; receiving a player input consistent with moving one or more of said plurality of unique game icons to group like game icons; responsive to said player input being deemed proper, moving said one or more of said plurality of unique game icons and deducting a bet amount; if said move causes three or more like game icons to be grouped in a pe-established pattern, identifying a corresponding pay table, based on a number of grouped like game icons, from multiple pay tables stored in said memory; and awarding a prize from said identified pay table.

In one embodiment, a plurality of gaming machines may be linked with a central computer to form a network of gaming machines configured as set forth herein. In one embodiment, the gaming machines described herein utilize interfaces in the form of displays having touch screen capability wherein the displays disseminate video content. The gaming machines used to facilitate the embodiments of the present invention may be standalone gaming machines, hand-held gaming devices, bar top gaming machines and the like.

Other variations, embodiments and features of the present invention will become evident from the following detailed description, drawings and claims.

DETAILED DESCRIPTION

Figure 1:
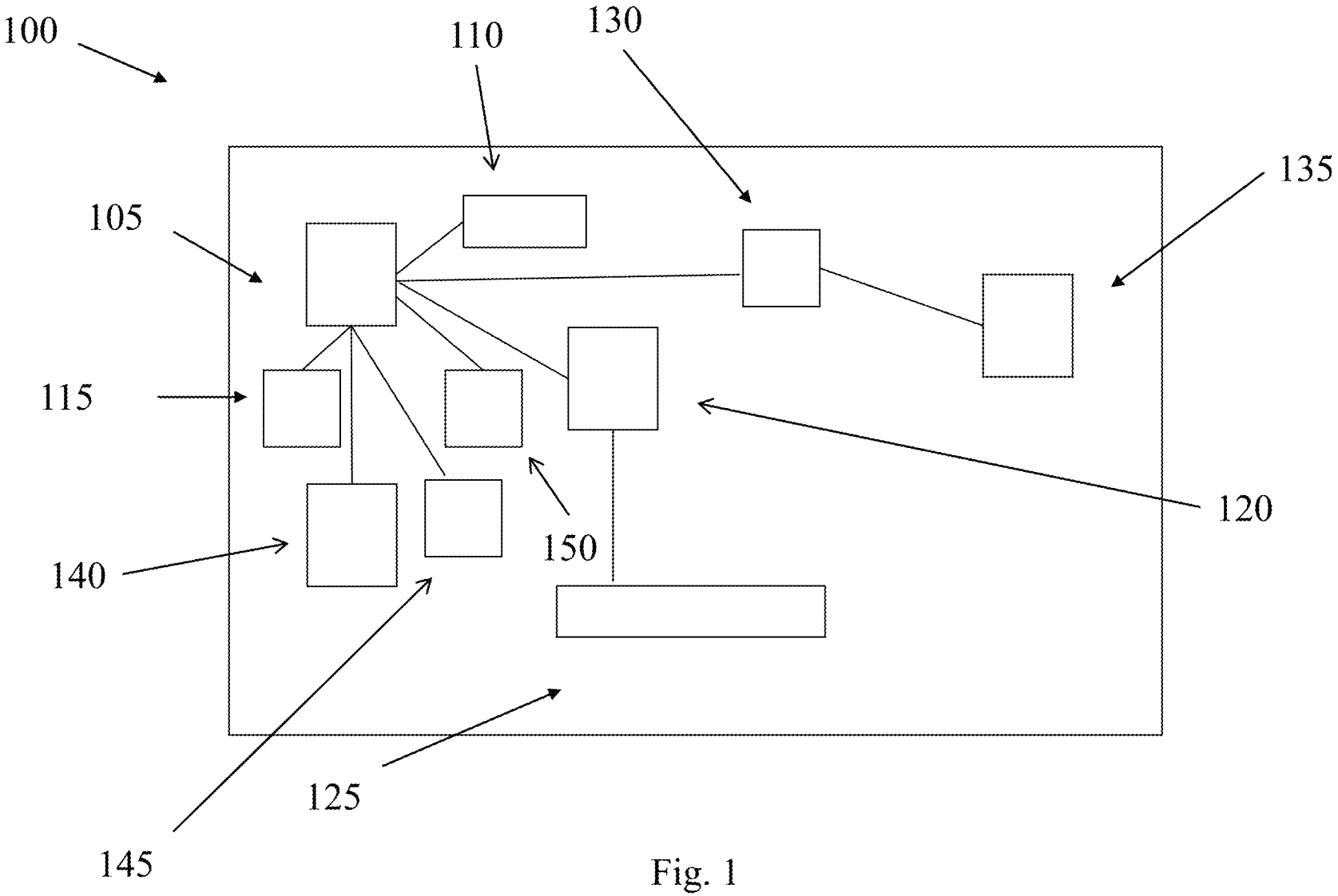
FIG. 1 illustrates a block diagram of components of an electronic gaming machine for conducting a game according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object-oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming machine" should be understood to be any one of a general purpose computer, as for example a personal computer, laptop computer, standalone machine, a client computer configured for interaction with a server, a special purpose computer such as a server, or a smart phone, soft phone, tablet computer, personal digital assistant or any other machine adapted for executing programmable instructions in accordance with the description thereof set forth above.

The embodiments of the present invention may be facilitated by an electronic gaming machine controlled by the electronic gaming machine's processor as described herein. The processor may be local or remote (i.e., server-based system). The electronic gaming machine may be a standalone device or bar-top device and forming part of a gaming machine network or not. A block diagram of an exemplary electronic gaming machine 100 is shown in FIG. 1. The exemplary electronic gaming machine 100 may include a central processing unit (CPU) also deemed a processor 105 which controls the electronic gaming machine 100 based on instructions stored in program read-only memory (ROM) 110 and pay table ROM 115. Program ROM 110 stores executable instructions related to the operation of the gaming machine 100 and which are generally permanent. CPU 105 may be connected to a video controller 120 which provides output to one or more video displays 125. Similarly, an audio controller 130 provides audio output as dictated by the CPU 105 through speakers 135. The aforementioned components, and others, may be attached to a circuit board forming a motherboard. In another embodiment, the electronic gaming machine 100 may be linked to a central game server which allows players to select from a number of games via the electronic gaming machine 100. In such an embodiment, one or more processors integrated into the central server control the gaming machine 100 based on instructions stored in program ROM 110.

A user interface 140 may comprise a button panel or display incorporating touch screen technology or any other devices (e.g., joy stick) providing means for users to communicate with, and instruct, the electronic gaming machine 100. Wager memory 145 stores an amount of money/credits deposited into the electronic gaming machine 100 by a player and specific wager information related to each play of the electronic gaming machine 100. Payout system 150 includes a coupon printer, bill validator and/or similar devices for receiving and distributing currency, tickets and/or coupons via the electronic gaming machine 100.

Those skilled in the art will recognize that the configuration and features of the electronic gaming machine 100 disclosed herein are exemplary and may be altered in any number of ways without impacting the embodiments of the present invention.

Figure 2:
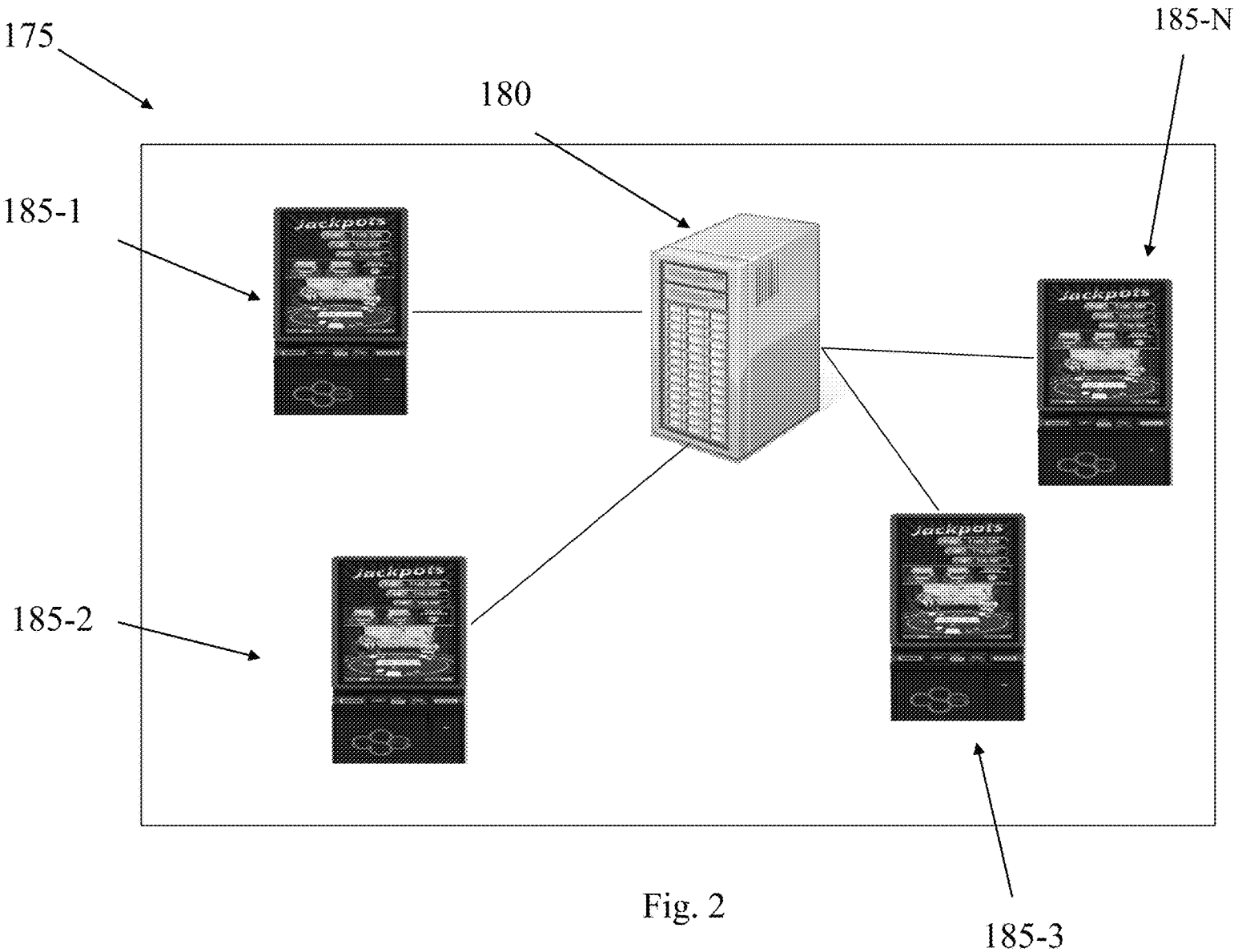
FIG. 2 illustrates a block diagram of a wireless network system accessible by mobile devices for conducting a game according to the embodiments of the present invention.

FIG. 2 shows a block diagram of a gaming network 175 which may be used to facilitate play of a casino-style game of chance via linked gaming machines according to the embodiments of the present invention. The gaming machine network 175 comprises a central processor 180 (e.g., processor-equipped game server) in communication with multiple gaming machines 185-1 through 185-N as described in FIG. 1. The gaming machines 185-1 through 185-N may be smart or dumb clients.

Figure 3:
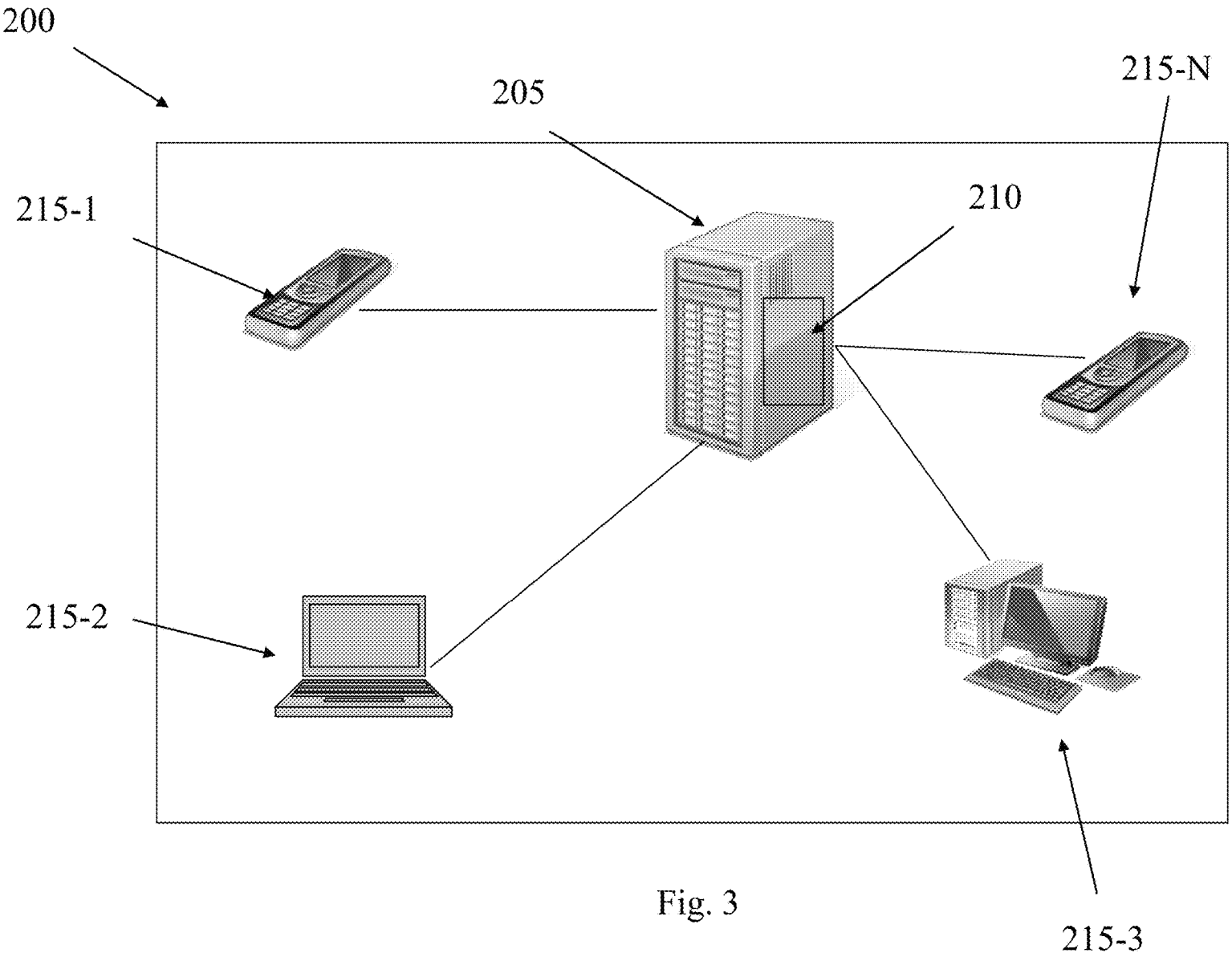
FIG. 3 illustrates a block diagram of a wireless network system accessible by mobile devices for conducting a game according to the embodiments of the present invention.

FIG. 3 shows a block diagram of a wireless gaming system 200 which may be used to facilitate remote play of a casino-style game according to the embodiments of the present invention. The wireless gaming system 200 comprises a processor-equipped game server 205, including one or more processors 210 running game software, and remote devices 215-1 through 215-N (e.g., smart phones) configured to access said game server 205 facilitating game play on the remote devices 215-1 through 215-N. In another embodiment, the video-based game according to the embodiments of the present invention may be in the form of a software application ("App") downloadable onto smart phones, tablets or computers and playable via processing power and a user interface associated therewith.

While the following description focuses on a casino-style video game involving a player selecting a game icon to move from a plurality of game icons. The objective of moving game icons is to group three or more like icons into pre-established winning patterns. Depending on the number of like grouped icons, a pay table from a plurality of pay tables is selected and a payout is rendered.

Figure 4A:
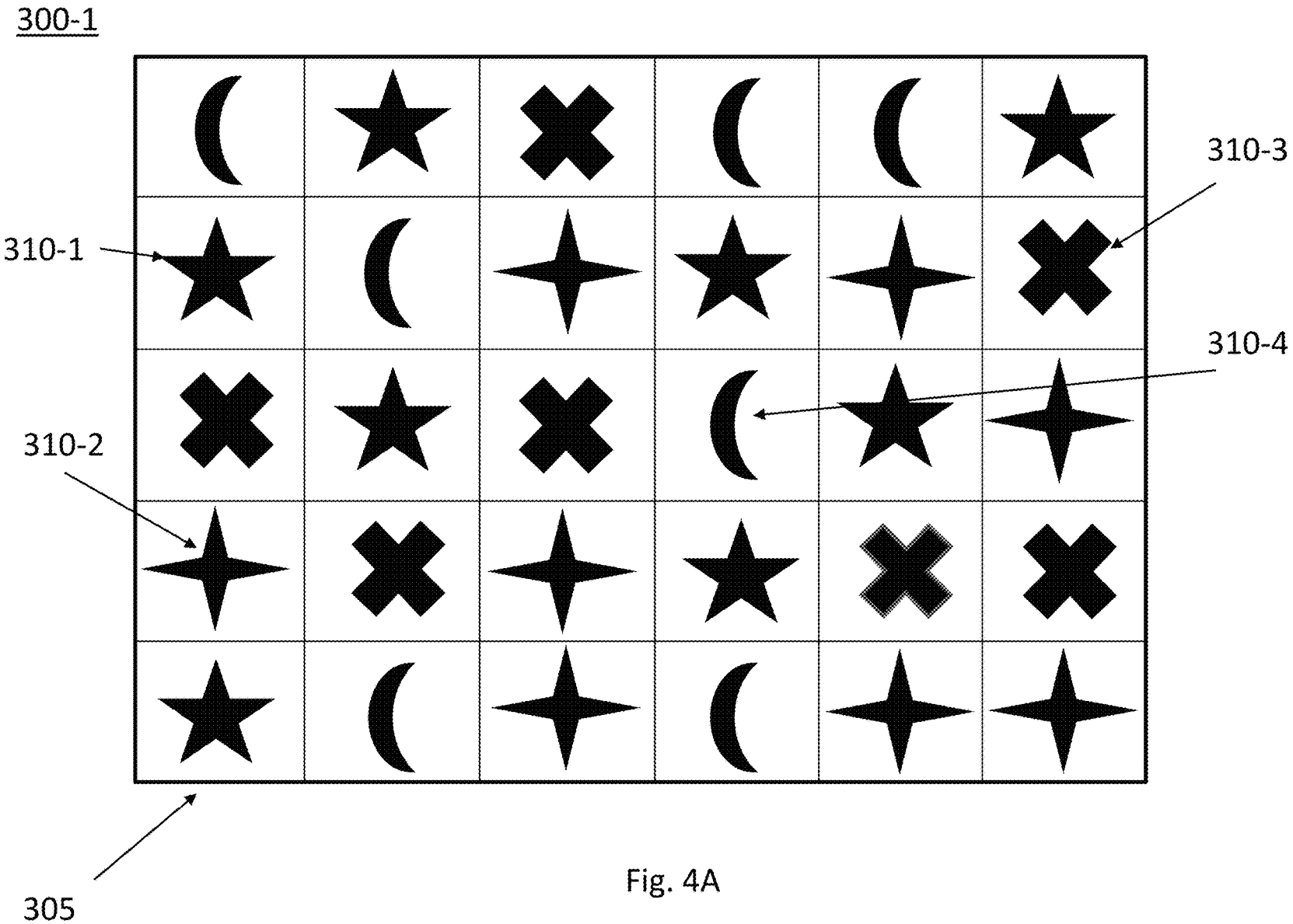
FIGS. 4A through 4D illustrate exemplary screen shots according to the embodiments of the present invention.
Figure 4B:
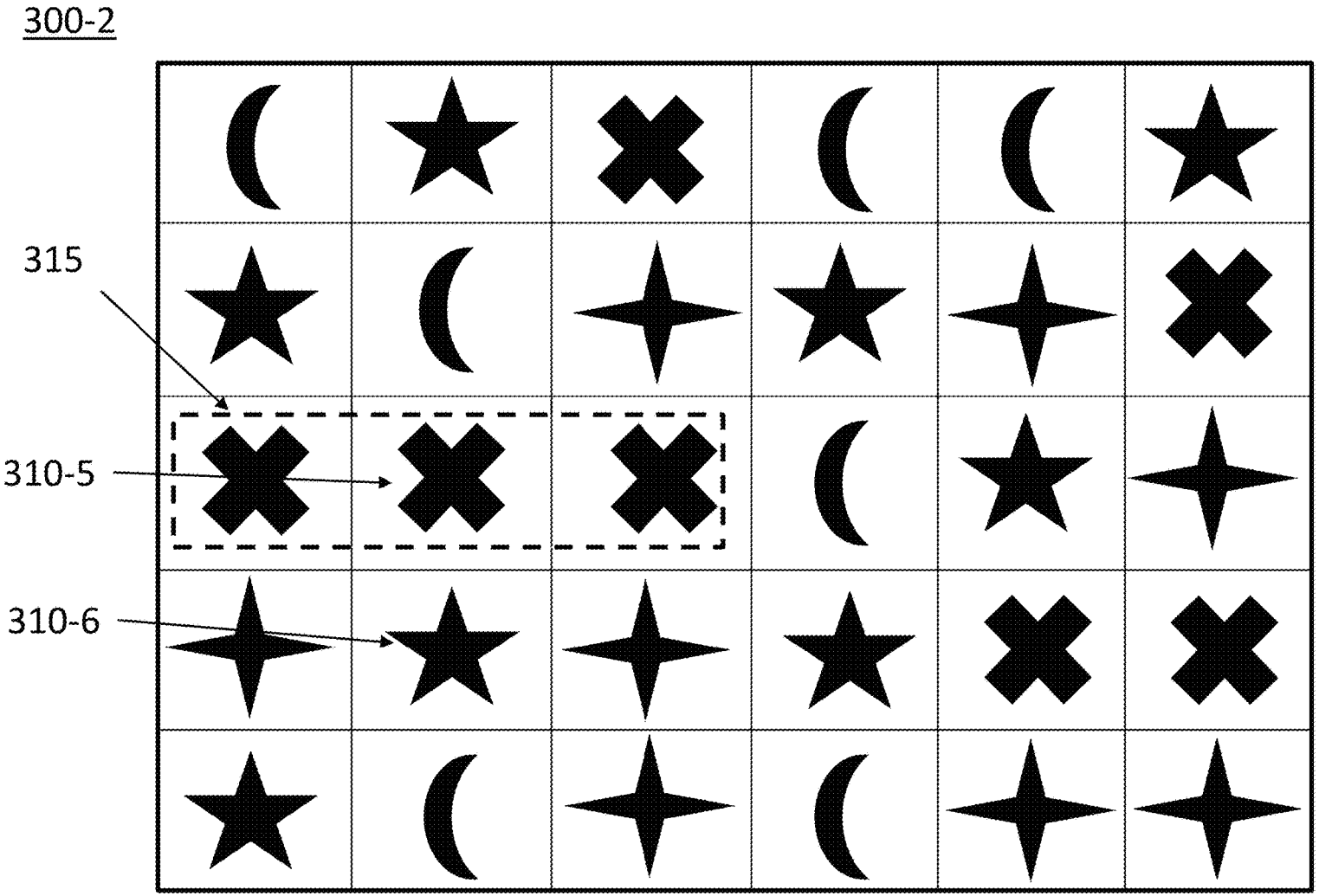
Figure 4C:
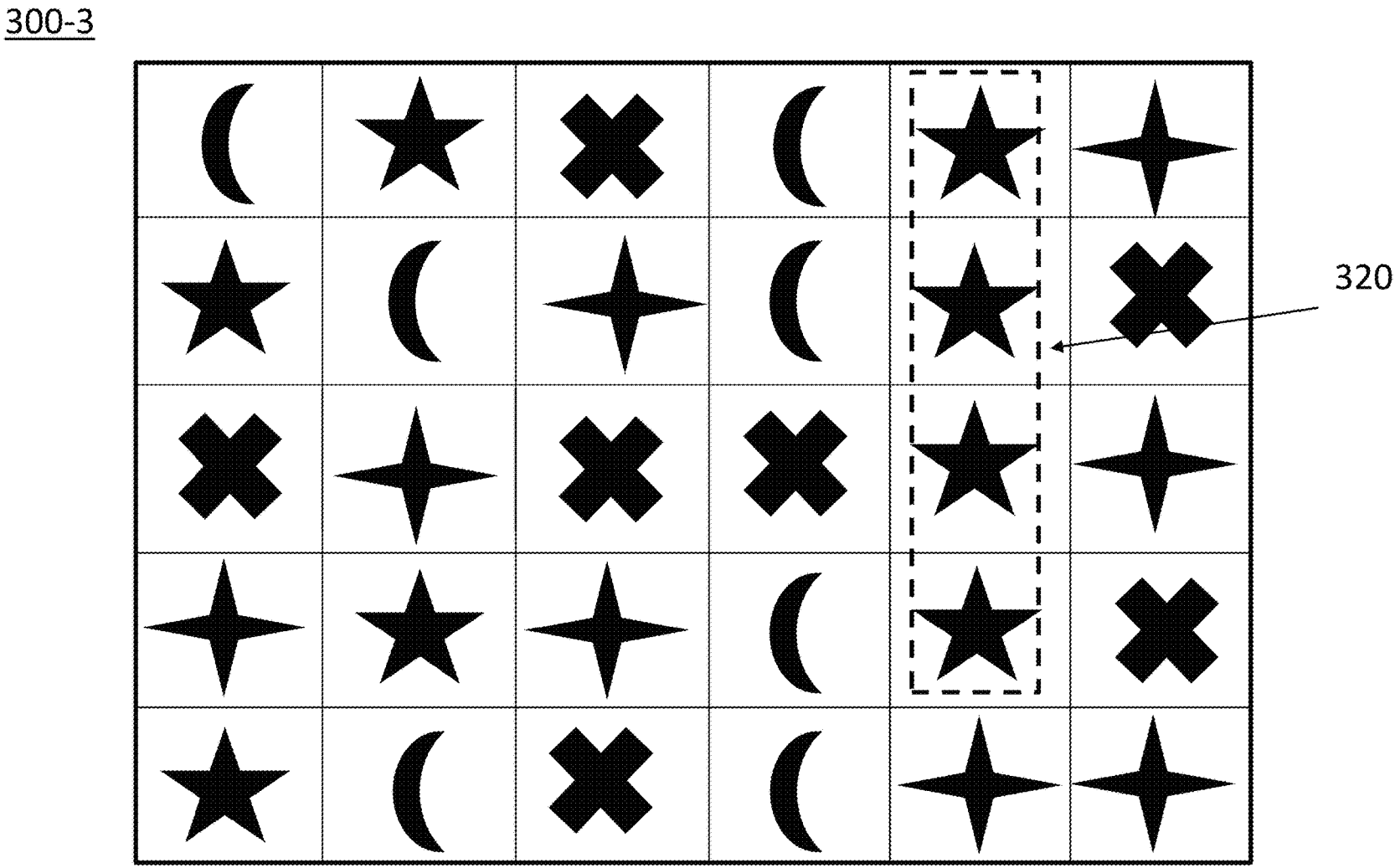
Figure 4D:
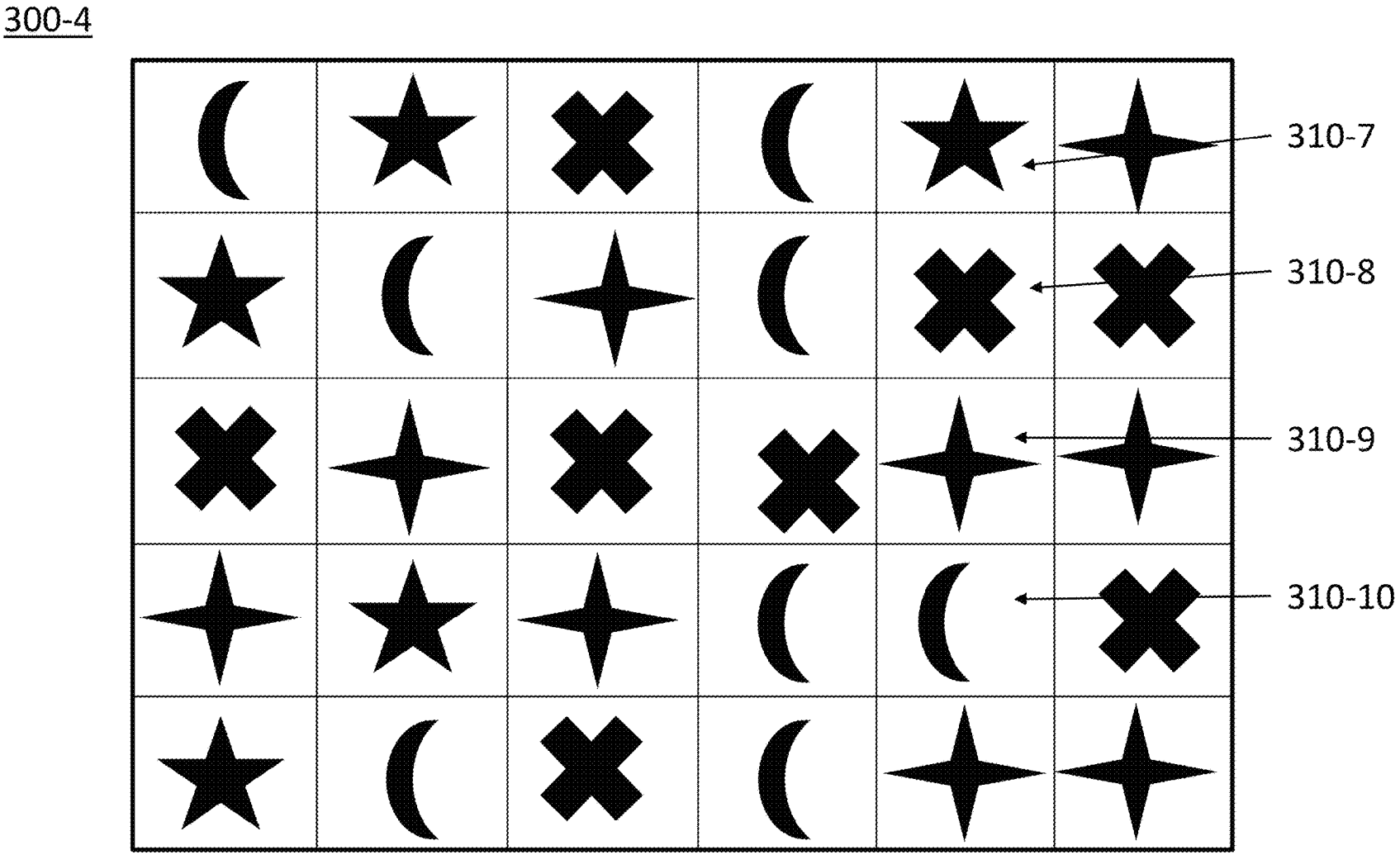

FIG. 4A shows a screen shot 300-1 depicting a game grid 305 formed of a plurality of unique game icons 310-1 through 310-4. While four unique game icons 310-1 through 310-4 are shown, those skilled in the art will recognize that more than four unique game icons may be utilized. FIG. 4B shows a screen shot 300-2 after a player has moved game icon 310-5 from column 2, row 4 to column 2, row 3 which causes game icon 310-6 to move from column 2, row 3 to column 2, row 4 resulting in a group 315 of three like game icons forming a horizontal winning pattern. In one embodiment, winning patterns include three or more like game icons aligned in a row (horizontal) or column (vertical). FIG. 4C shows a screen shot 300-3 with a group 320 of four like game icons forming a winning vertical pattern. In one embodiment, any game icon may be moved one space left, right, up or down. In one embodiment, when a game icon is moved to a new space, the game icon in that space is automatically moved to the space the moved game icon has vacated (i.e., the game icons swap spaces). In one embodiment, a game icon can only be moved to form a winning pattern. In other words, the system prevents a game icon from being moved unless a winning pattern is formed by the attempted move. FIG. 4D shows a screen shot 300-4 after the winning pattern of four like game icons in screen shot 300-3 is removed and replaced with new game icons 310-7 through 310-10. The new game icons 310-7 through 310-10 may simply appear in the spaces or may drop down from the top individually.

Figure 5A:
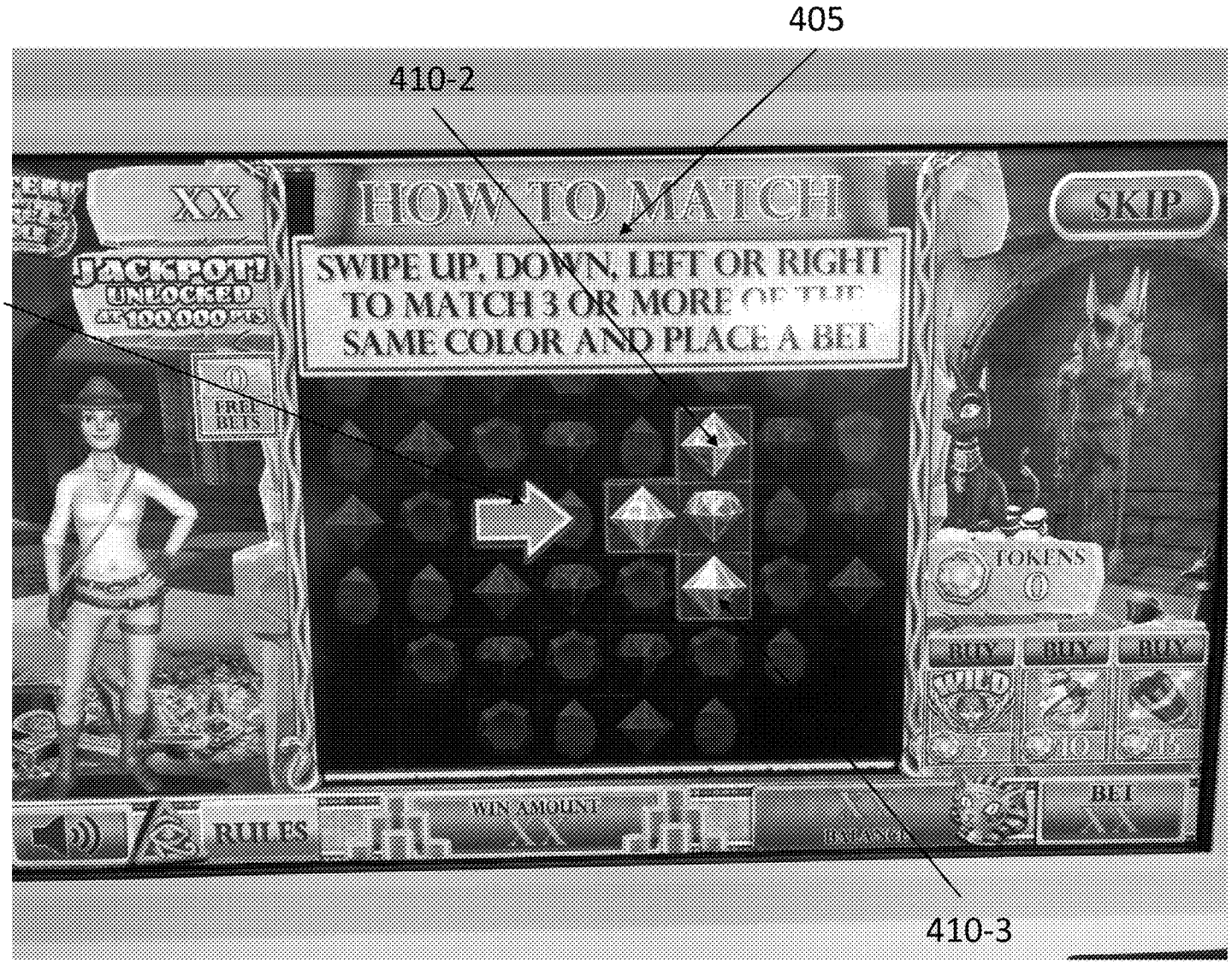
FIG. 5A through 5C illustrate exemplary video game screen shots according to the embodiments of the present invention.

FIG. 5A shows a video game screen shot 400-1 with instructions 405 on how to move game icon 410-1 to form a winning pattern. In this instance, moving game icon 410-1 to the right forms a group of three like game icons 410-1 through 410-3 which will result in a winning vertical pattern.

Figure 5B:
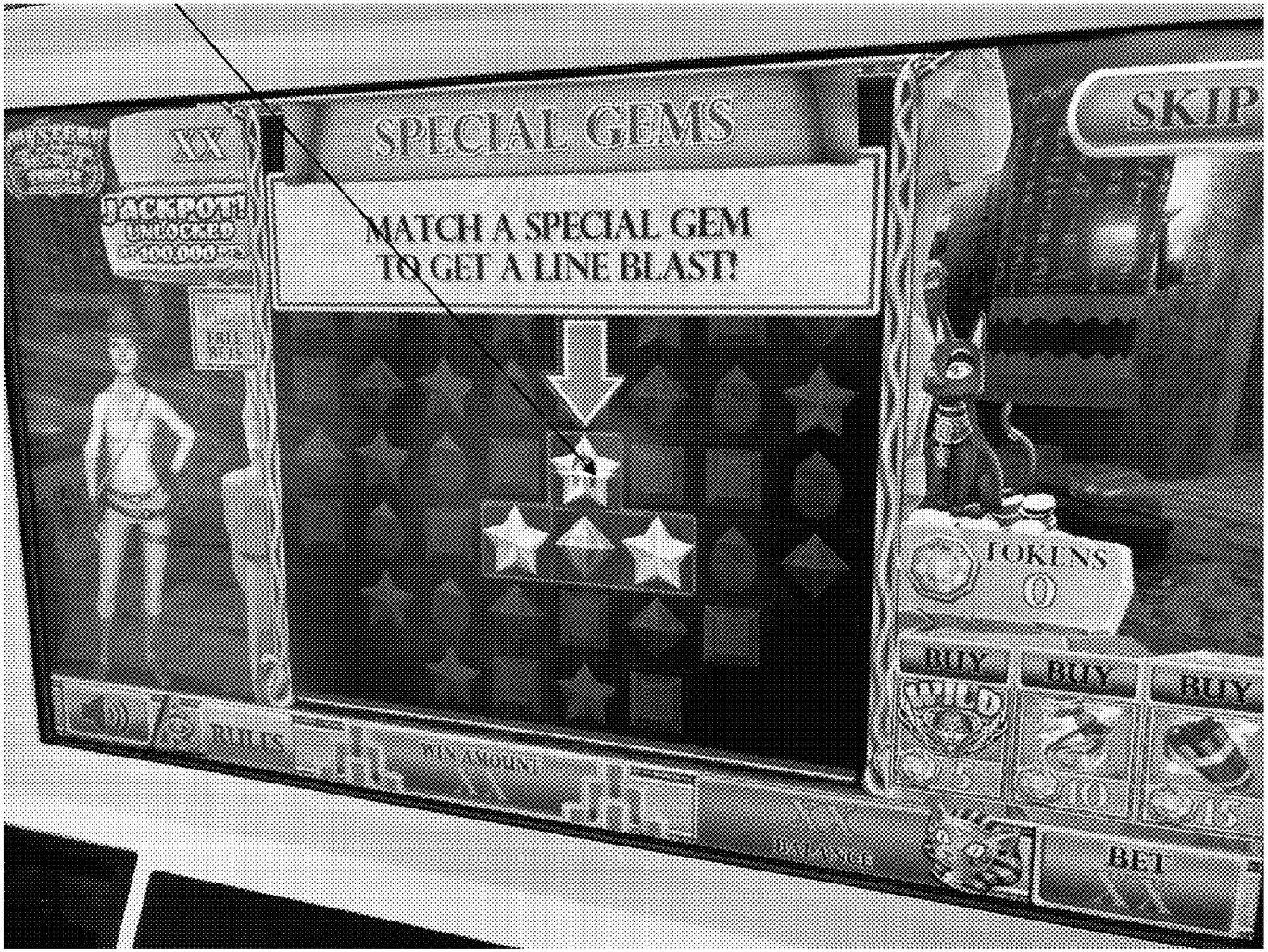
Figure 5C:
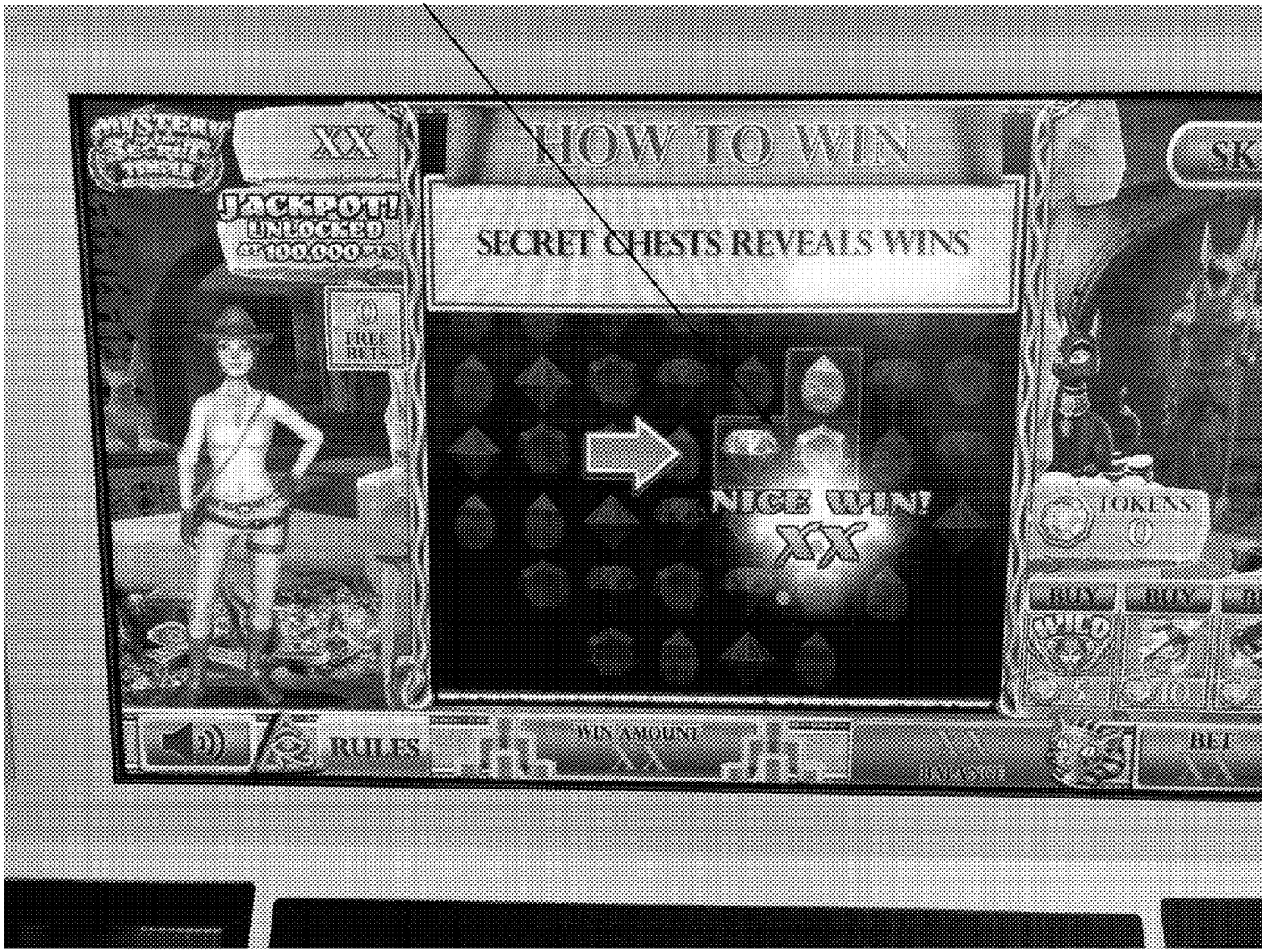

FIG. 5B shows a video game screen shot 400-2 depicting a special game icon 420, which may provide a bonus if used as part of a wining pattern. FIG. 5C shows a video game screen shot 400-3 depicting a 2× win based on a pre-established pattern and game icon being used to form a winning pattern. The combinations of game icons and winning patterns are countless and may be developed to create a reasonable player return such that the house maintains the overall advantage. Time may also be incorporated into the payout scheme such that the longer it takes a player to make a move resulting in a winning pattern, the lessor the payout. By way of example, if a player takes less than 2 seconds to make a move resulting in a winning pattern, the player receives 100% of the corresponding pay table payout whereas if it takes the player more than 2 seconds to make a move resulting in a winning pattern, the player receives less than 100% (e.g., 85%) of the corresponding pay table payout.

In one embodiment of the present invention, the system utilizes multiple pay tables to render payouts based on winning patterns being formed. In one embodiment, the multiple pay tables have differing return to player (RTP) percentages and are based on the number of game icons forming the winning pattern. In one embodiment, the larger the number of game icons forming the winning pattern, the greater the RTP of the corresponding pay table. Table 1 below shows numbers of winning game icons in a winning pattern and corresponding RTPs associated with exemplary pay tables.

TABLE 1

| # OF GAME ICONS IN WINNING PATTERN | RTP OF PAY TABLE |
|---|---|
| 3 | 94% |
| 4 | 96% |
| 5 | 98% |

Besides multiple pay tables and time to create a winning pattern, manipulating the house advantage may be accomplished by the arrangement of game icons on the game grid 305. The game icons may be positioned such that a large number (e.g., five) of possible game icon moves will result in winning patterns or the game icons may be arranged such that a small number (e.g., one) of possible moves exist to create a winning pattern. The size the game grid 305 may also be changed. The game may also utilize multiple levels whereby various parameters are changed to render the game easier or more challenging.

Figure 6:
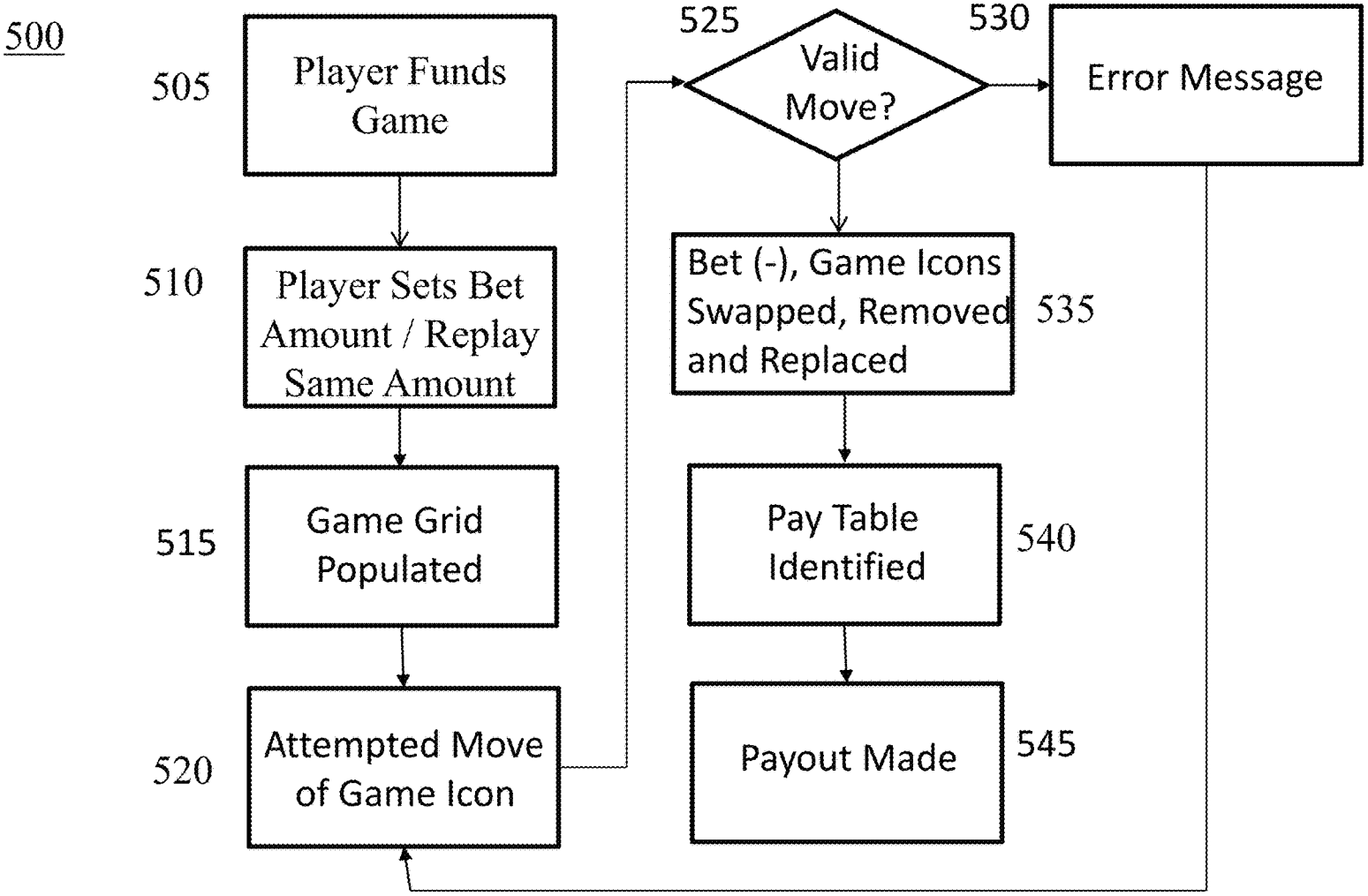
FIG. 6 illustrates a flow chart detailing one methodology for conducting a casino-style game according to the embodiments of the present invention.

FIG. 6 shows a flow chart 500 detailing one methodology for conducting a casino-style game according to the embodiments of the present invention. At 505, a player funds the gaming machine with currency, coupons or tickets. At 510, the player selects a bet amount. At 515, a populated game grid is presented on a gaming machine display. At 520, a player attempts to move a game icon to create a winning pattern or group. At 525 it is determined if the attempted move is valid. If the move is invalid (i.e., does not result in a winning pattern), at 530, an error message is depicted on the gaming machine display and the move is not permitted to occur. If, at 525, the move is deemed valid, at 535, the two game icons swap spaces, are removed and new game icons populate the spaces defining the winning pattern. The move acts as the bet as well, such that at 535, the bet is also deducted from a credit amount. At 540, based on the number of game icons forming the winning pattern, a pay table from multiple pay tables is identified. At 545, a payout is made from the identified pay table.

Although the invention has been described in detail with reference to several embodiments, additional variations and modifications exist within the scope and spirit of the invention as described and defined in the following claims.

We claim:

1. A gaming machine comprising:

a monetary input device configured to receive a physical item associated with a monetary value;

a user interface configured to:

enable a player to select a wager for a game of chance and enable the player to initiate a cash out operation;

at least one processor running executable instructions related to a game of chance;

said at least one processor programmed to:

add said monetary value to a credit balance for said player;

deduct said selected wager from said credit balance; and decrease said credit balance in response to said cash out operation;

a display;

a ticket reader;

a bill validator;

memory in communication with said processor, said memory storing at least multiple pay tables; and wherein said processor running said executable instructions: (i) causes to be displayed a grid comprising a plurality of unique game icons; (ii) receives a player input consistent with moving one or more of said plurality of unique game icons to group like game icons; (iii) responsive to said player input being deemed proper, causes to be moved said one or more of said plurality of unique game icons and a bet amount to be deducted; (iv) if said move causes three or more like game icons to be grouped in a pre-established pattern, identifies a corresponding pay table, based on a number of grouped like game icons in said pre-established pattern, from said multiple pay tables stored in said memory, said multiple pay tables having increasing RTP as the number of grouped like icons increases; and (iv) awards a prize from said identified pay table.

2. The gaming machine of claim 1 wherein said multiple pay tables each have a different RTP.

3. The gaming machine of claim 1 wherein said processor is further configured to:

cause payouts to be impacted by an amount of time necessary for a player to make a valid move of said one or more of said plurality of unique game icons.

4. The gaming machine of claim 1 wherein said one or more game icons provide enhanced payouts when used to form a pre-established pattern.

5. The gaming machine of claim 1 wherein an arrangement of said plurality of said one or more game icons is designed to influence ease of play.

6. The gaming machine of claim 1 wherein said pre-established pattern is a horizontal row or vertical column of three consecutive like game icons.

7. A gaming machine network comprising:

a plurality of gaming machines in communication with a central computer, each gaming machine having a display; user interface; ticket reader; bill validator; memory in communication with a processor; said memory storing at least multiple pay tables; and a monetary input device configured to receive a physical item associated with a monetary value;

said user interface configured to:

enable a player to select a wager for a game of chance and enable the player to initiate a cash out operation;

said processor running executable instructions related to a game of chance;

said processor programmed to:

add said monetary value to a credit balance for said player;

deduct said selected wager from said credit balance; and decrease said credit balance in response to said cash out operation; and wherein said processor running executable instructions: (i) causes to a grid of a plurality of unique game icons to be presented on said display; (ii) receives a player input consistent with moving at least one of said plurality of unique game icons to form a pattern of like game icons; (iii) responsive to said player input being deemed proper, causes to move said at least one of said plurality of unique game icons and a bet amount to be deducted; (iv) if said move causes three or more like game icons to be grouped in a pre-established pattern, identifies a corresponding pay table, based on a number of grouped like game icons in said pre-established pattern, from said multiple pay tables stored in said memory, said multiple pay tables having increasing RTP as the number of grouped like icons increases; and (iv) awards a prize from said identified pay table.

8. The gaming machine network of claim 7 wherein said multiple pay tables each have a different RTP.

9. The gaming machine network of claim 7 wherein said processor is further configured to: cause payouts to be impacted by an amount of time necessary for a player to make a valid move of said one or more of said plurality of unique game icons.

10. The gaming machine network of claim 7 wherein said one or more game icons provide enhanced payouts when used to form a pre-established pattern.

11. The gaming machine network of claim 7 wherein an arrangement of said plurality of said one or more game icons is designed to influence ease of play.

* * * * *